United States Patent [19]

Gibbs

[11] 4,113,246

[45] Sep. 12, 1978

[54] EXERCISING APPARATUS

[76] Inventor: David James Gibbs, 6 Linden Close, Green Park, Wootton Bassett, Swindon, Wiltshire, England

[21] Appl. No.: 693,965

[22] Filed: Jun. 7, 1976

[30] Foreign Application Priority Data

Jun. 7, 1975 [GB] United Kingdom ..... 24542/75

[51] Int. Cl.[2] ..... A63B 23/06

[52] U.S. Cl. ..... 272/69; 128/57; 193/35 R

[58] Field of Search ..... 272/70, 69, 94, 96, 272/99, 100, 116, 131, 132, 134, 144, 56.5 R, 56.5 SS; 128/25 R, 25 B, 57; 104/135, 54, 69, 70; 193/35 R, 37, 15, 17, 2 A, 35 J; 35/29 E

[56] References Cited

U.S. PATENT DOCUMENTS

| | | | |
|---|---|---|---|
| 897,722 | 9/1908 | Day | 272/69 |
| 931,394 | 8/1909 | Day | 272/69 |
| 1,544,555 | 7/1925 | Chase | 104/69 X |
| 1,748,425 | 2/1930 | Odell | 128/57 |
| 1,766,089 | 6/1930 | Wood | 272/69 |
| 1,884,430 | 10/1932 | Warren | 104/69 |
| 2,600,747 | 6/1952 | Faust | 193/35 R X |
| 3,205,888 | 9/1965 | Stroop | 272/69 X |
| 3,385,599 | 5/1968 | Davis | 193/35 R X |
| 3,415,514 | 12/1968 | Weihs | 272/69 X |
| 3,650,529 | 3/1972 | Salm et al. | 272/69 |
| 3,840,102 | 10/1974 | Dawson | 193/35 R |

FOREIGN PATENT DOCUMENTS

| | | | |
|---|---|---|---|
| 1,478,027 | 7/1969 | Fed. Rep. of Germany | 272/69 |
| 225,034 | 11/1924 | United Kingdom | 272/69 |

*Primary Examiner*—Richard C. Pinkham
*Assistant Examiner*—Arnold W. Kramer
*Attorney, Agent, or Firm*—Young & Thompson

[57] ABSTRACT

Exercising apparatus includes a frame having parallel side members and a central rib disposed intermediate the side members, with a plurality of parallel spindles extending between the central rib and each of the side members. A plurality of closely spaced independently rotatable rollers of smooth cylindrical form and uniform size are mounted on each spindle to make a row, with the rows being closely spaced. Hand grips are provided either at the sides of the apparatus or at one end thereof.

2 Claims, 3 Drawing Figures

-FIG. 1-

EXERCISING APPARATUS

This invention relates to exercising apparatus and is particularly concerned with apparatus for use by patients in hospitals for physiotherapeutic purposes and by persons wishing to attain or retain physical fitness.

Exercising apparatus is available which includes a supporting base carrying a pair of spaced rollers around which an endless belt is entrained, a person standing on the belt holding a pair of hand-grips and effectively "walking" along the belt at a rate determined by the output speed of an electric motor which drives one of the rollers. Such apparatus is extremely useful but it is large and expensive. It is accordingly an object of the invention to provide exercising apparatus which is of compact robust construction and relatively inexpensive to manufacture.

According to the invention there is provided exercising apparatus comprising a supporting framework including a platform and hand-grip means for gripping by a person standing on the platform, said platform having a presented surface afforded by a multiplicity of rollers comprising a plurality of rows of rollers with each row of rollers containing a plurality of rollers and the rollers being arranged for rotation about substantially horizontal axes.

The area occupied by the rollers is conveniently of the order of one foot in width and two feet three inches in length, each roller having a length and a diameter of, for example, seven eighths of an inch. During movement of the feet of a person standing on the platform, the rates of rotation of the different rollers will not be the same because of the different modes of movement of the various parts of a person's foot. It is, therefore, important that there should be a large number of rollers.

Means are preferably provided for adjusting the inclination of the platform to the horizontal, the arrangement being such that the rate at which the user of the apparatus has to move to maintain his position on the rollers is dependent on the inclination of the platform. Said adjustment means may comprise a stepped base which is provided with formations for engagement with cooperative formations on the underside of the platform. The formations on the underside of the platform are preferably recesses and the formations on the base are preferably a plurality of projections on each step.

In order to facilitate use of the apparatus in confined spaces and to enable transport and storage of the apparatus to be carried out more easily, the framework of the apparatus conveniently comprises a plurality of dismantleable components, the hand-grip means being afforded by a generally U-shaped member having legs which clip into and are held within sockets disposed outwardly of a peripheral frame around the rollers. Provision may be made for adjustment of the height of the hand-grip means in accordance with the height of the user of the apparatus. Alternative forms of hand-grip means may also be provided. There are preferably four sockets, two at each end of the platform and the hand grip means may comprise a single U-shaped member disposed at one end of the platform or two U-shaped members disposed one at each side of the platform.

The framework of the apparatus is conveniently formed from aluminium or steel tubes and the rollers formed from a synthetic plastics material, for example nylon which may incorporate a lubricant, for example, molybdenum disulphide.

The invention will now be described by way of example with reference to the accompanying drawings in which:-

Figure 1:
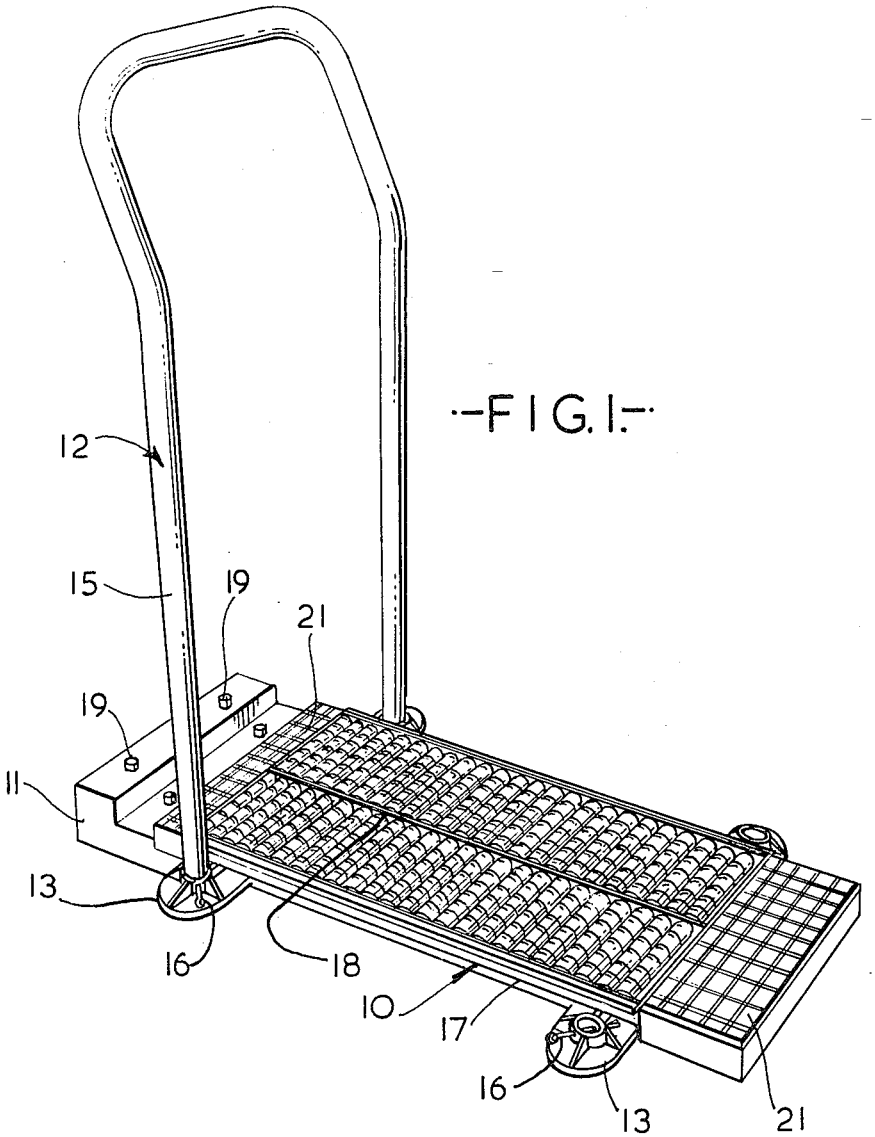
FIG. 1 is a perspective view of an exercising apparatus.

The apparatus shown is FIG. 1 consists of a platform 10, a base 11 and a U-shaped hand-grip 12. The platform 10 includes a frame of rectangular form in plan view with a projecting lug 13 at each corner of the frame. Each lug 13 includes a flat base portion and an upwardly extending central socket 14, the socket 14 being of such dimensions that the ends of the legs 15 of the U-shaped hand-grip 12 are close fits therein, the end portions of the legs 15 and the sockets 14 being provided with registering apertures (not shown) in which split pins 16 are fitted to hold the hand-grip firmly in position.

The frame of the platform 10 serves to support 22 rows of 12 rollers, each row of rollers being supported on a spindle which has its ends mounted in a side member 17 of the frame and is supported intermediate its ends by passage through an opening in a centrally upstanding rib 18 forming part of the frame. The platform is formed as a metal casting and the rollers are of nylon loaded with a solid lubricant such as molybdenum disulphide whereby each of the rollers is independently and freely rotatable on its respective supporting spindle. When a user of the apparatus is standing on the platform his weight is supported by the rollers and the platform 10 as a whole is mounted at an inclination to the horizontal so that the rollers will tend to rotate in a direction such that eventually the person will effectively slide off the platform. It is accordingly necessary, for maintenance of his position that the user of the apparatus should walk or jog at a rate determined by the inclination of the platform.

As previously explained, it is important that there should be a large number of rollers and that the rollers should be independently rotatable to allow for the different modes of movement of a person's foot. The spindles on which the rollers are mounted are accordingly disposed 1 inch apart, the rollers being 7/8 of an inch in diameter and three quarters of an inch long, with six rollers on each side of the central rib 18. The platform 10 is formed as a casting and this rib 18 is formed integrally with the side and end members which form a peripheral frame around the rollers. The lugs 13 are also integral parts of this casting.

The base 11 provides three horizontal steps; as shown in FIG. 1 the platform 10 is supported on the lowermost step and the inclination of the platform to the horizontal is at its minimum value. When the platform 10 is instead supported on the middle or uppermost step, the inclination of the platform to the horizontal is appropriately increased. In the particular embodiment shown in FIG. 1, each step of the base 11 is provided with two spaced upstanding pins 19 which are arranged to locate in correspondingly spaced apertures 20 formed in the undersurface of the platform 10 adjacent one end thereof. The particular pin and aperture arrangement that has been developed is of advantage in that it ensures that there are no projecting parts on the platform that might inadvertently be damaged or cause damage to a floor covering.

Figure 2:
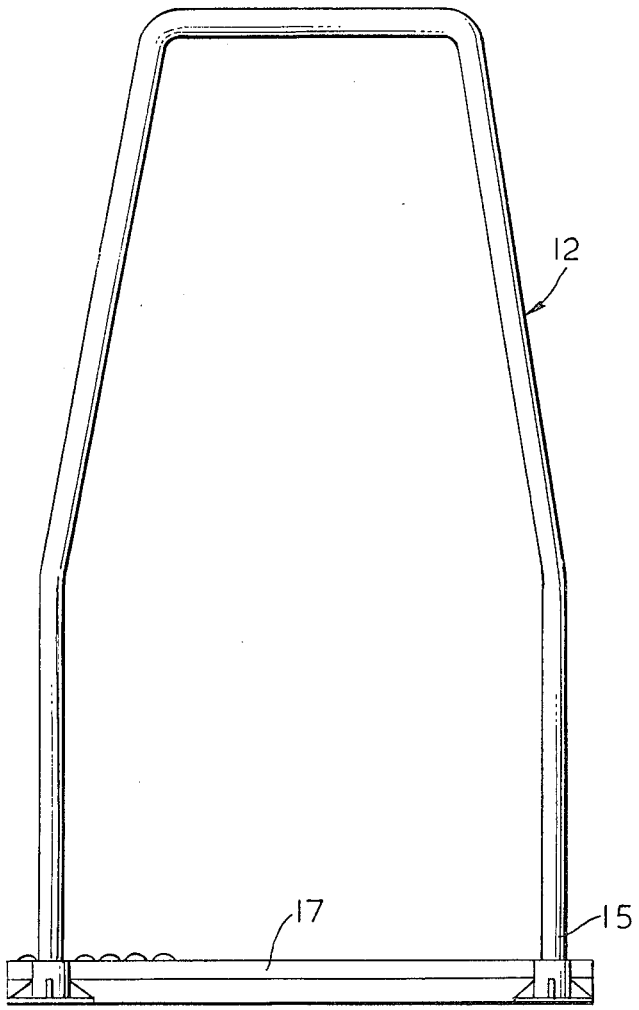
FIG. 2 is a side view of the apparatus showing an alternative form of hand-grip as compared of that shown in FIG. 1.
Figure 3:
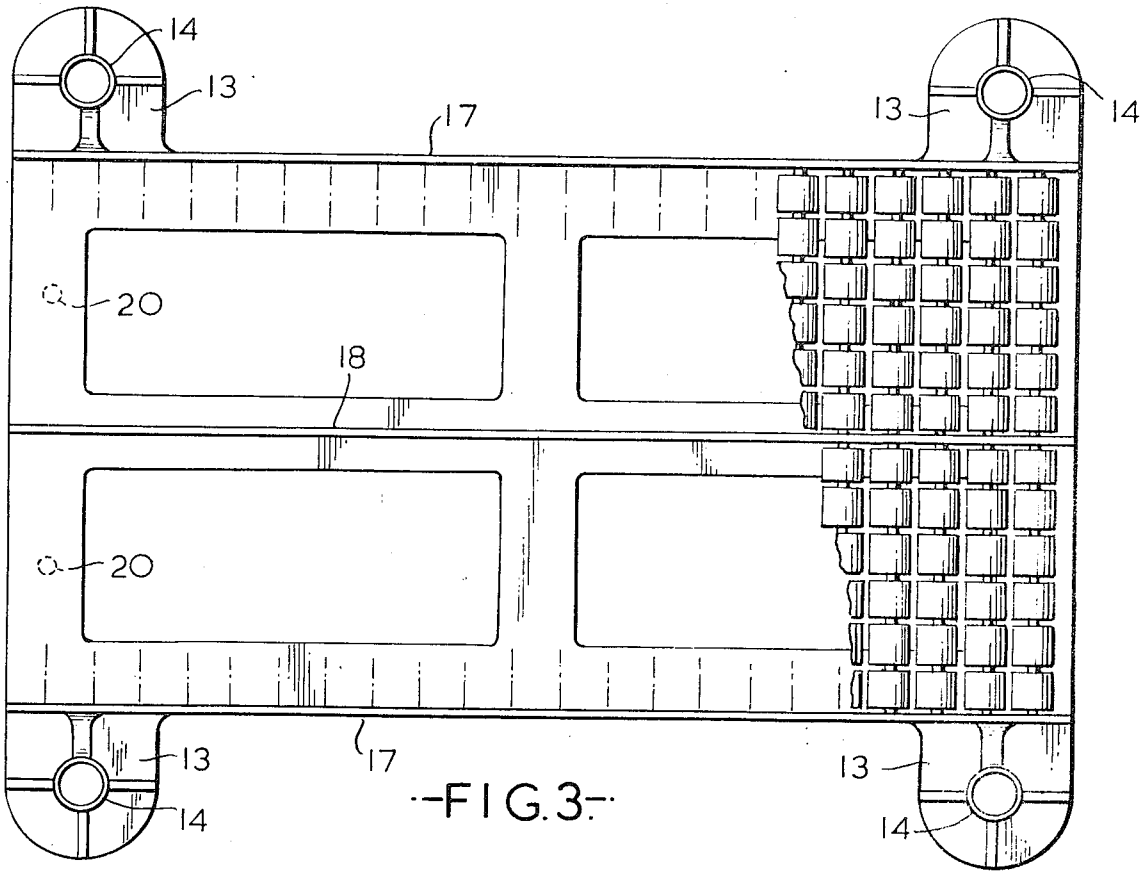
FIG. 3 is a plan view of the platform of the apparatus without any form of hand-grip.

FIG. 1 shows an embodiment in which the U-shaped hand grip 12 is disposed at one end of the platform 10 with the lower ends of its legs 15 fitting in the two sockets 14 at that end of the platform. In contrast therewith, FIG. 2 shows an embodiment in which a hand grip 12 of slightly different configuration is employed with the spacing between the legs 15 thereof increased sufficient to enable the lower ends thereof to fit in the two sockets 14 at one side of the platform. Two such hand grips are normally employed, i.e. one at each side of the platform. For a relatively fit person taking exercises, the single hand grip of FIG. 1 should be used whereas two hand grips, each shown in FIG. 2, are recommended for the elderly and infirm.

Tread pads 21 may be provided at each end of the platform 10, as shown in FIG. 1.

What I claim is:

1. Exercising apparatus comprising a supporting framework including a platform on which the user of the apparatus can stand and handgrip means for gripping by a person standing on the platform, said platform having a presented surface afforded by a multiplicity of rollers comprising a plurality of closely spaced rows of rollers which each row of rollers containing a plurality of closely spaced independently rotatable rollers, the rollers being of smooth cylindrical form and of uniform size with a diameter no more than about an inch and a length no more than about an inch, said rollers being arranged for rotation about substantially horizontal axes contained in a common plane, the platform including a frame having parallel side members and a central rib disposed intermediate the side members, a plurality of parallel spindles extending between the central rib and each of the side members and the rollers being individually mounted on said spindles.

2. Exercising apparatus according to claim 1, wherein said spindles are disposed about one inch apart, said rollers being about seven eighths of an inch in diameter and about three quarters of an inch long, there being about six rollers on each side of said central rib.

* * * * *